US005970969A

United States Patent [19]

Anttila et al.

[11] Patent Number: 5,970,969

[45] Date of Patent: Oct. 26, 1999

[54] DEVICE FOR THROWING TARGETS

[75] Inventors: Martti Anttila; Peter Gustafsson, both of Arboga, Sweden

[73] Assignee: Gosta Gustafsson Makaniska, Arboga, Sweden

[21] Appl. No.: 09/129,638

[22] Filed: Aug. 5, 1998

[51] Int. Cl.[6] ..... F41J 9/18

[52] U.S. Cl. ..... 124/8

[58] Field of Search ..... 124/8, 36

[56] References Cited

U.S. PATENT DOCUMENTS

| | | | |
|---|---|---|---|
| 3,093,127 | 6/1963 | Starr | 124/8 |
| 3,826,238 | 7/1974 | Hansen | 124/8 |
| 3,937,203 | 2/1976 | Riedmueller et al. | 124/8 |
| 3,971,357 | 7/1976 | LaPorte et al. | 124/8 |
| 5,249,563 | 10/1993 | Patenaude | 124/8 |

*Primary Examiner*—John A. Ricci

*Attorney, Agent, or Firm*—Sughrue, Mion, Zinn, Macpeak & Seas, PLLC

[57] ABSTRACT

A target throwing device, particularly for throwing frangible targets, such as "clay targets", has a first pivotal shaft, an arm mounted to said first shaft for throwing a target, and a spring connected to said first shaft by means of an eccentric wheel for rotation of the throwing arm during a target throwing operation. A second pivotal shaft which is essentially coaxial with said first shaft, has a drive motor coupled thereto for rotation thereof. Furthermore, the first and second shafts are interconnected so as to permit mutually independent rotation of the first and second shafts through an angle of between essentially 180° and 360°, whereby the spring can rotate the first shaft at a high speed during the throwing operation.

7 Claims, 5 Drawing Sheets

DEVICE FOR THROWING TARGETS

FIELD OF INVENTION

The present invention relates generally to the dispensing of objects and particularly to a device for throwing frangible targets, such as "clay targets" or "clay pigeons".

BACKGROUND OF THE INVENTION

Devices for throwing plate type targets wherein the throwing or catapult arm is mechanically driven are well known in the art. In such devices the drive means, which actually imparts momentum to the throwing arm, is typically a powerful traction spring. The prior art devices thus generally comprise a throwing arm, designed to accommodate a frangible target plate, mounted on one end of a rotatable shaft. The other end of the rotatable shaft is mechanically coupled to a mechanism, which is connected to the traction spring. In operation the throwing arm is moved to an angular position in which the spring is stretched and the arm is thereafter released for the throwing stroke.

Various techniques and devices have been proposed to accomplish, against the force of the traction spring, the cocking of the throwing arm. By way of example, use has been made of crank mechanisms, wherein the throwing arm and the crank mechanism are affixed to a pivotal shaft. A traction spring is attached to the crank mechanism, which is driven by an electric motor.

The prior art devices have been characterized by a relatively complicated design, including unidirectional clamping means.

OBJECT OF THE INVENTION

An object of the present invention is to provide a device for throwing targets and which has a simple and reliable design.

SUMMARY OF THE INVENTION

The invention is based on the insight that two essentially coaxial, semi-independently rotating shafts can be used. With the present invention, there has been provided a target throwing device having a first pivotal shaft, an arm mounted to said first shaft for throwing at least one target, a spring means connected for rotation of said arm during a target throwing operation, an eccentric first wheel mounted on said first shaft, wherein said spring means in connected to said first shaft by means of said first wheel, a second pivotal shaft, said second shaft being essentially coaxial with said first shaft, a drive motor means coupled to said second pivotal shaft for rotation thereof, and means for interconnecting said first and second shafts so as to permit mutually independent rotation of said first and second shafts through an angle of between essentially 180° and 360°.

BRIEF DESCRIPTION OF THE DRAWINGS

The present invention may be better understood and its objects and advantages will become apparent to those skilled in the art by reference to the accompanying drawings wherein like reference numerals refer to like elements in the several figures and in which.

DETAILED DESCRIPTION OF THE INVENTION

Figure 1:
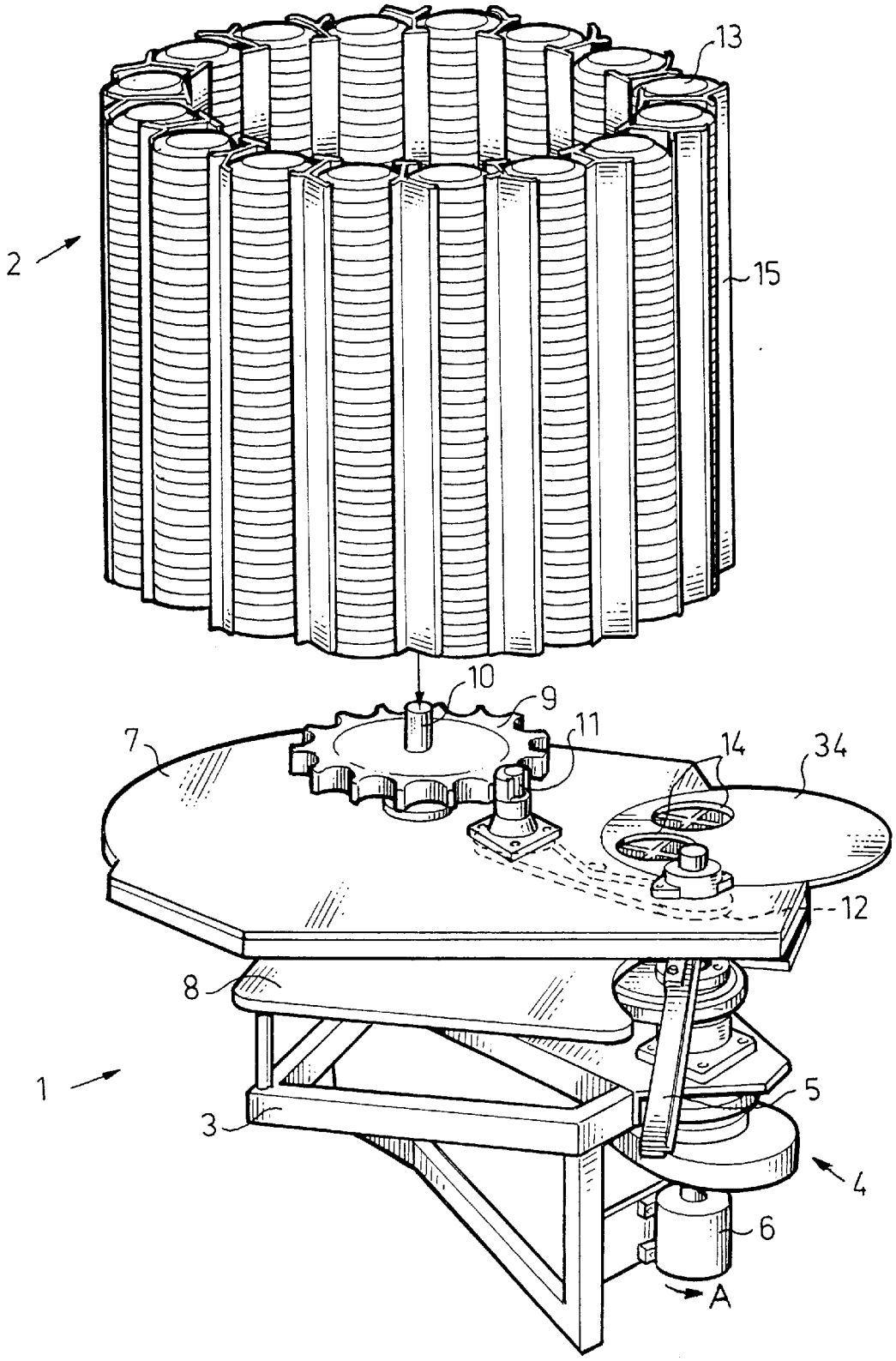
FIG. 1 is a perspective view of a target-throwing device in accordance with the present invention.

Referring now to FIG. 1, a target-throwing device is depicted, which consists of two main parts, namely, a lower part 1, which represents the actual trap for clay targets with a cocking and hurling arrangement, and a rotatable, round magazine 2 arranged above this lower part 1 of the machine, with arrangements for the reception of a fairly large number of clay targets and for the automatic placement each time of one or two of these targets on the lower part 1.

The lower part 1 has a frame 3 which is mounted in the customary manner on a support, not shown, which may be adjustable for vertical as well as lateral movement, so that the direction of the throw can be adjusted. The frame 3 mounts a shaft assembly, generally designated 4, for a throwing arm 5 as well as for the magazine 2. The shaft assembly 4 is driven by a drive motor 6 connected to one end of the shaft assembly, preferably by means of a gear so as to give the shaft assembly a suitable rotational speed.

The lower part 1 further comprises a top plate 7 supporting the magazine and a lower plate 8, intended for support of targets ready to be thrown. The magazine 2 is supported by means of a toothed wheel 9 having an upwardly directed tap 10, onto which the magazine is placed. The toothed wheel 9 is rotated by means of a driving tap 11, which in turn is driven by the shaft assembly 4 by means of a driving chain 12.

A turnable disc 34 is mounted in the top plate 7 and on level therewith. Thereby the top plate 7 and the disc form one plane on which the stacks of targets 13 in the magazine can slide. The disc 34 is provided with two circular holes or apertures 14, each having a diameter adapted to receive a target 13 from the magazine 2. Stacks of targets 13 are held in place in the magazine by means of profile elements 15 placed in a circle, see FIG. 1.

Figure 2:
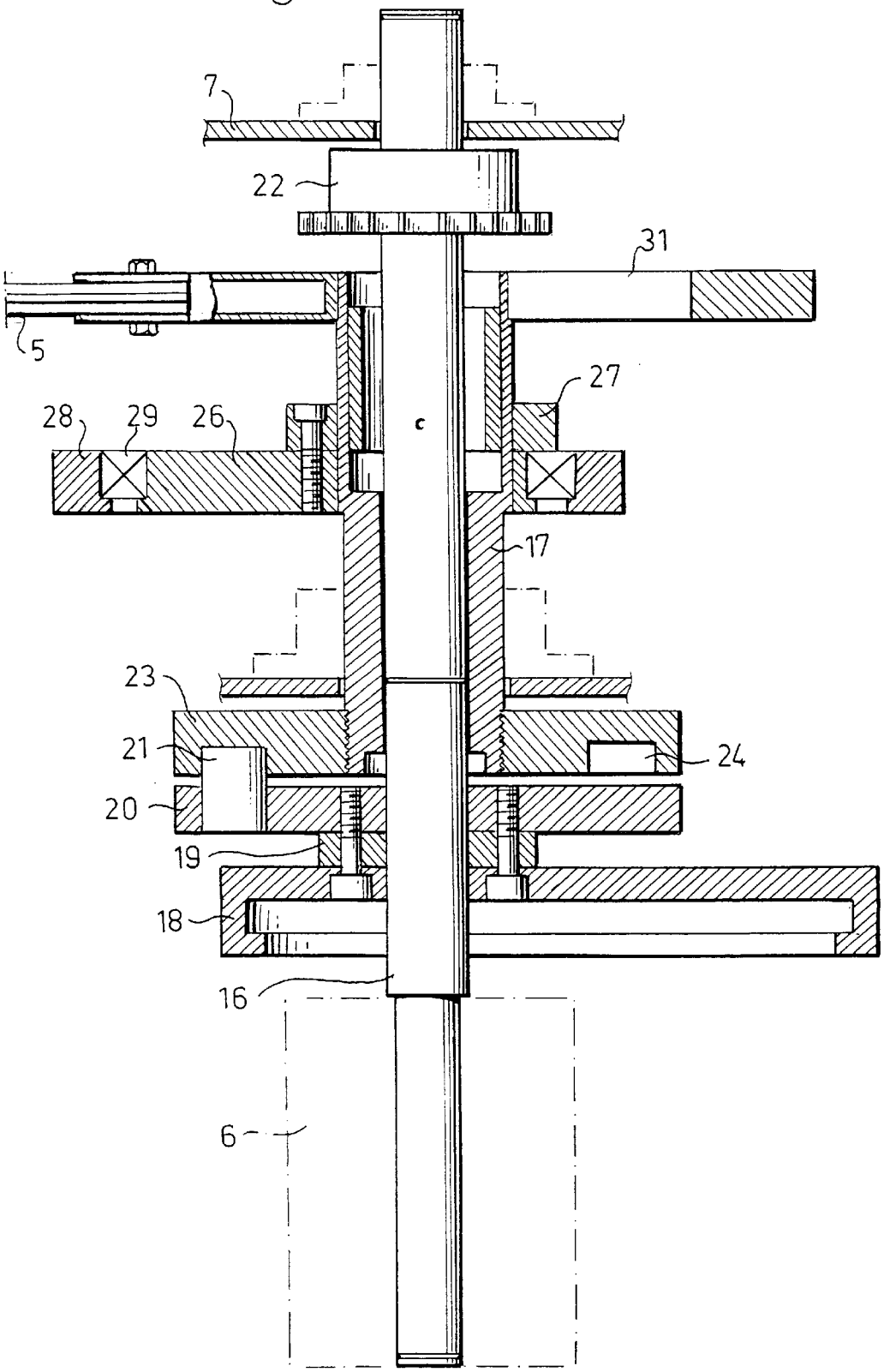
FIG. 2 is a cross-sectional side elevation view of a shaft assembly of the device shown in FIG. 1.
Figure 6:
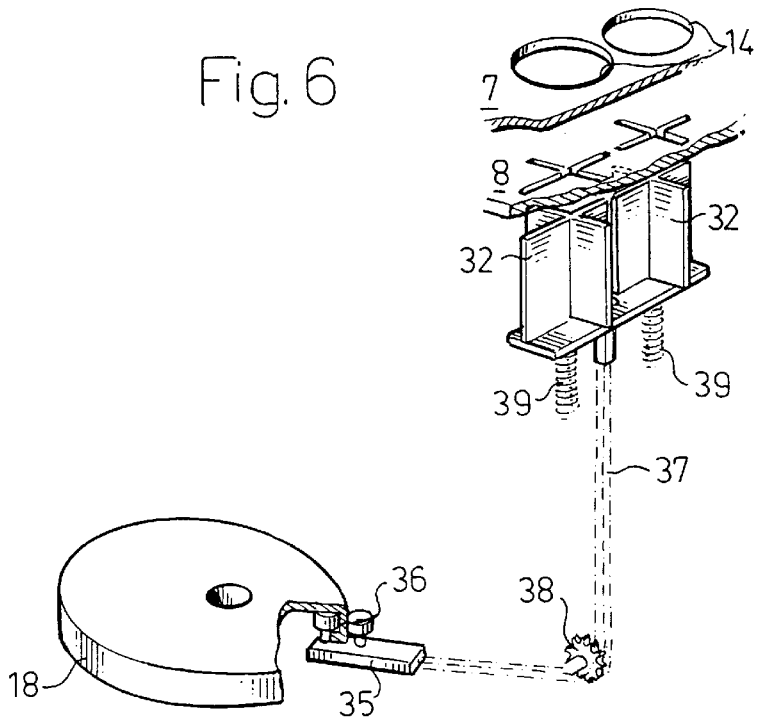
FIG. 6 is a perspective view showing a target elevator arrangement.

The operation of the shaft assembly 4 will now be explained with reference to FIGS. 2 and 3, in which a cross sectional and an exploded perspective view, respectively, of the shaft assembly are shown. The main parts of this assembly are a solid shaft 16 and a co-axially mounted hollow shaft 17 mounted thereon. The solid shaft 16 is driven by the electric motor 6 connected to the lower end thereof. An eccentric wheel 18 for an elevator arrangement, the function of which will be described later with reference to FIG. 6, is mounted to the shaft 16 by means of a lock wheel 19. Further, a drive wheel 20 provided with a tap 21 is mounted against rotation to the solid shaft 16, also by means of the lock wheel 19.

A gear ring 22 is mounted at the top end of the solid shaft 16, opposite to the end to which the drive motor is connected. The function of this gear ring 22 is to drive the chain 12 shown in FIG. 1 and driving the magazine 2. This function is synchronized so that the magazine is rotated an angle corresponding to one clay target for each throw. In that way the magazine is uniformly emptied as it rotates.

A driven wheel 23 with a concentric groove 24 on the underside thereof is mounted to the lower end of the hollow shaft 17. The groove 24 is interrupted by a stop part 25, see FIG. 3. During operation, the tap 21 of the drive wheel 20 runs in the groove 24, allowing mutual rotating movement between wheels 20 and 23 through an angle of almost 360°. The meaning of that will become clear when the operation of the device is described below.

An eccentric wheel 26 is fixedly mounted to the hollow shaft 17 by means of a lock wheel 27. A spring mounting ring 28 is mounted to the eccentric wheel 26 by means of a bearing 29. The spring mounting ring 28 is provided with a socket, which receives the first end of a traction spring 30. The second end of the traction spring is secured to the frame 3 so that the force exerted by the spring 30 during throwing is directed essentially symmetrically in respect to the center of gravity of the throwing device. In the preferred embodiment, said second end of the spring 30 is secured to the frame essentially directly below the center of the magazine 2. This ensures a minimum of disruptive forces during operation. Thereby, a stronger traction spring can be used, enabling simultaneous throwing of two targets.

Finally, a mounting element 31 for the throwing arm 5 is provided at the upper end of the hollow shaft 17.

In the following, the operation of the throwing device will be described with reference to FIGS. 1–4. Initially, in a resting position, the throwing arm 5 is in a position that essentially corresponds to that shown in FIG. 1. In that position, the traction spring has a minimum load, i.e., the eccentric wheel 26 is in a position that minimizes the distance between the spring mounting ring 28 and the second end of the traction spring 30 secured to the frame 3. This is the position to which the force of the traction spring 30 tries to move the eccentric wheel 26 and which is shown in FIG. 4*a*.

Figure 3:
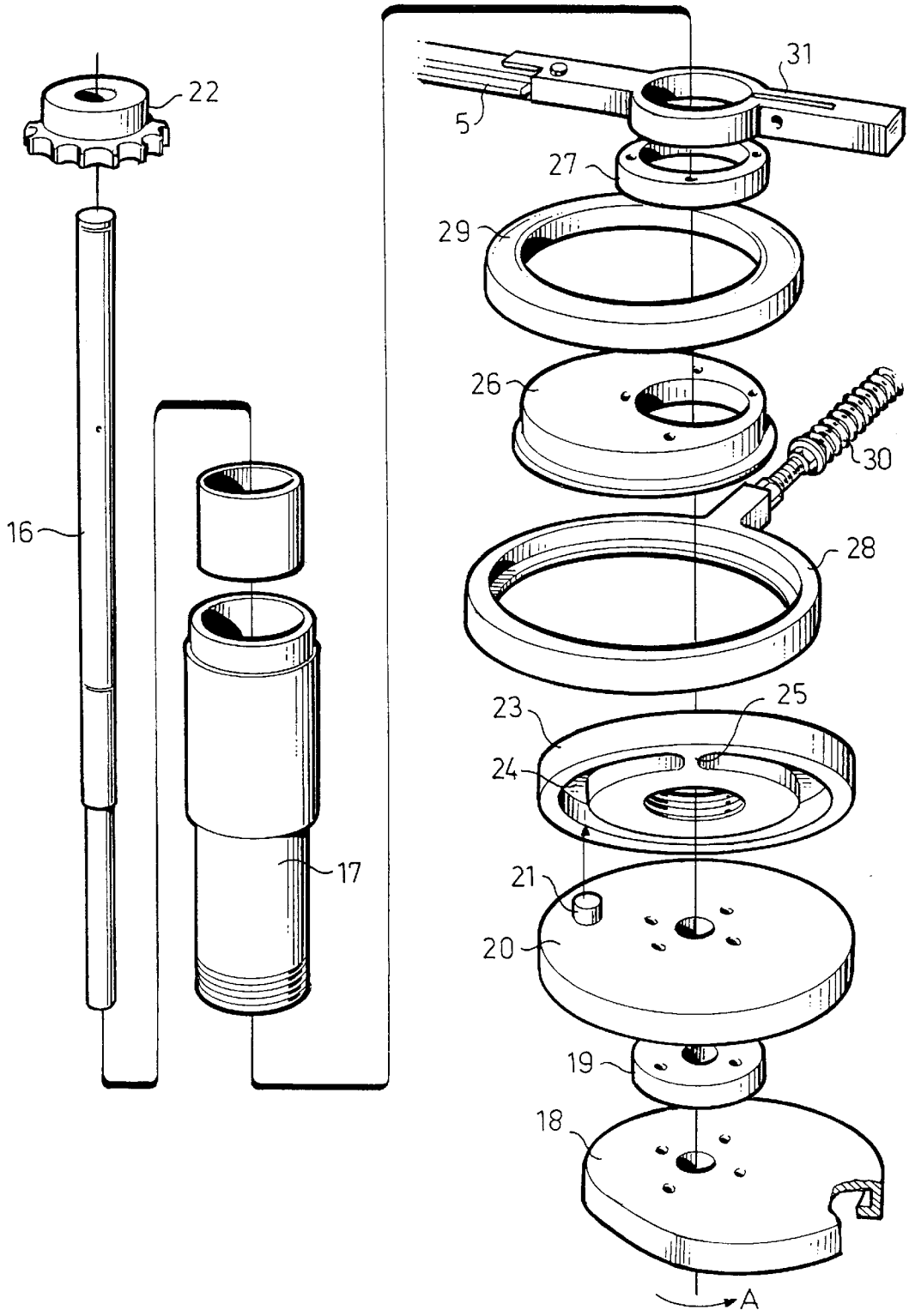
FIG. 3 is an exploded perspective view of the shaft assembly shown in FIG. 2.
Figure 4A:
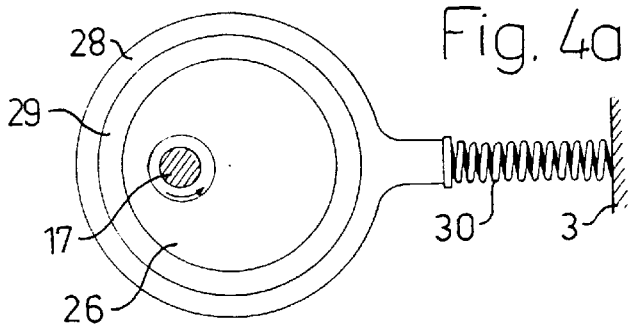
FIGS. 4*a–d* is a top view showing a spring stretching arrangement.

To initiate the cocking operation, the drive motor 6 is activated, wherein the motor shaft and therewith the solid shaft 16 connected thereto begin to rotate in the direction of the arrow A in FIGS. 1 and 3. The driving wheel 20 rotates with the solid shaft 16. However, the driven wheel 23 and therewith the hollow shaft 17 to which it is connected do not rotate until the tap 21 of the drive wheel 20 abuts the stop part 25 at the end of the concentric groove 24 in the driven disc.

Figure 4B:
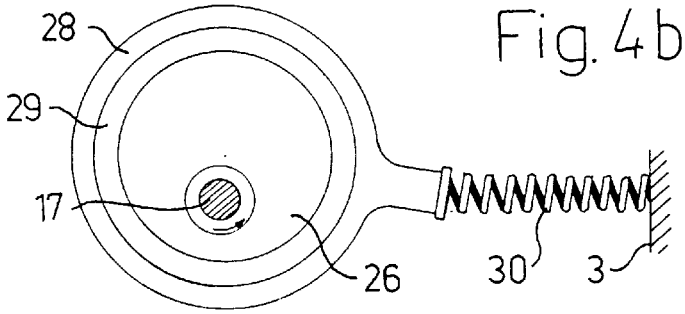

When the tap 21 abuts the stop part 25, the tap 21 brings with it the driven wheel 23, which then rotates together with the drive wheel 20. Now, also the hollow shaft 17 and the eccentric wheel 26 as well as the throwing arm 5 rotate with the drive wheel 20 in the direction of arrow A. During this rotation, the eccentric wheel brings the spring mounting ring 28 to a position further away from the second end of the traction spring 30, which thereby is stretched. A cocking position halfway to a fully cocked position is shown in FIG. 4*b*.

Figure 4C:
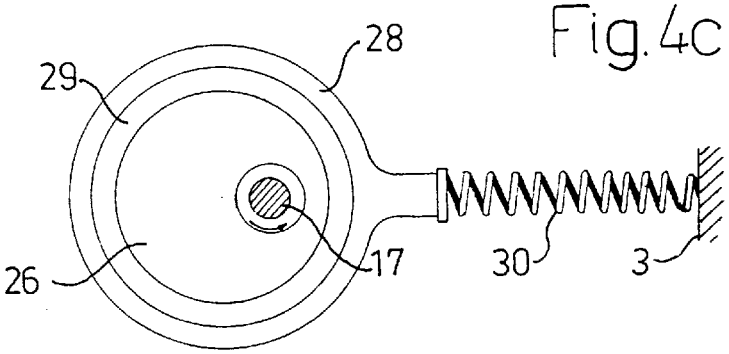

This rotation continues until the traction spring is almost fully stretched, i.e. for slightly less than 180° rotation of the hollow shaft 17. This corresponds to a cocked position and is shown in FIG. 4*c*. In this position the driving of the solid shaft 16 by the motor 6 is deactivated until the throw should be effected. This deactivation can be effected by means of a micro switch (not shown).

During rotation of the solid shaft 16, also the magazine 2 is rotated by means of the gear ring 22, chain 12, tap 11 and tooted wheel 9. During rotation, the stacks of targets 13 in the magazine 2 are brought to slide on the top plate 7 to a position, wherein two stacks reach a position above a respective hole 14 in the turnable disc 34. They are then brought to the lower support plate 8 by means of an elevator arrangement which is shown in more detail in FIGS. 5 and 6 and the function of which will be described below. Resting on the lower support plate 8, the targets are on level with and close to the throwing arm 5 in the fully cocked position.

Figure 4D:
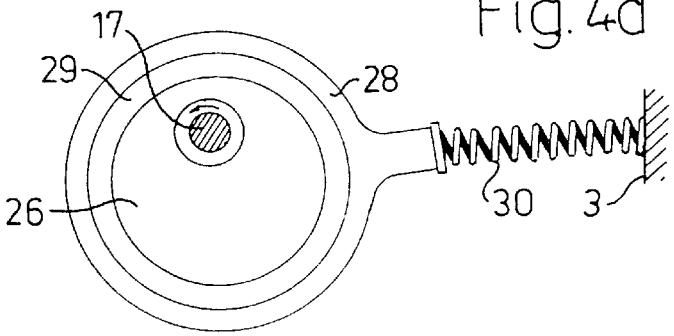

When a throw is to be effected, the hollow shaft 17 and the means connected thereto is rotated a little further from the above-mentioned cocked position shown in FIG. 4*c* by energizing the drive motor 6. The eccentric assembly comprising parts 26–30 will then pass a point of equilibrium wherein the traction spring 30 has maximum energy, i.e., is stretched the most. After the equilibrium point is passed the eccentric assembly will be rotated solely under the influence of traction spring 30 and the traction spring will thus impart a high speed to the throwing arm 5 which will throw the targets. A position in the middle of the throw is shown in FIG. 4*d*.

During the throw, the hollow shaft 17 can rotate independently of the solid shaft 16 because of the interaction of the drive wheel 20 and the driven wheel 23. During the throw, the hollow shaft 17 rotates with a high speed imparted by the force of the traction spring 30 whereas the solid shaft 16 continues to rotate with the previous speed, i.e., with the speed given by the drive motor 6. Due to this difference in speeds, the tap 21 of the drive wheel 20 runs in the groove 24 in the driven wheel 23. The angle through which the solid shaft 16 rotates during the actual throw is very small and can therefore be ignored and the throwing arm 5 is assumed to go through an angle of approx. 180° from the cocked position to the resting position. Therefore, the tap 21 runs about half way backwards along the groove 24 during the throw and the groove 24 in the driven wheel 23 must thus permit the hollow shaft 17 to rotate at least 180° in respect to the solid shaft 16. Otherwise, the inertia of the throwing arm 5 would damage the gear connecting the drive motor 6 to the solid shaft 16 because the force of the throw would be applied to the solid shaft 16 as well, should the shafts 16 and 17 not be allowed to rotate independently of each other.

For practical purposes this allowed angle of independent rotation should be more than 180° because of the overshoot of the throwing arm 5 past the resting position. In the preferred embodiment shown in the figures, the groove 24 in the driven wheel 23 allows almost 360° independent rotation.

Thus, this drive-driven wheel arrangement provides for a simple and reliable means to allow semi-independent rotation of the shafts 16, 17. Furthermore, the use of an eccentric wheel on the hollow shaft for transferring the power of the traction spring to the throwing arm allows use of a solid shaft going all along the shaft arrangement. A hollow shaft mounted co-axially on the solid shaft gives a very strong construction which enables the use of a very strong spring.

After having thrown the targets, the arm 5 will return to its initial position under the force of the spring 30 and the procedure is repeated.

The arrangement retaining the targets in the magazine 2 and the elevator assembly will now be described with reference to FIGS. 5 and 6. During the cocking operation, two targets will slide to a position directly above a respective hole 14, as already mentioned. Two cross-shaped holders 32 for a respective target are then on level with the top plate 7. When the targets are in position on these holders 32, the elevator assembly begins to move vertically downwards, bringing the targets with it. This vertical movement of the holders 32 is effected by means of the eccentric wheel 18 mounted to the solid shaft 16. An attachment assembly 35 provided with two wheels is mounted to slide on a depending flange 36 of the wheel 18. The attachment assembly is connected to the holders 32 by means of a chain 37 and a toothed wheel 38. The holders 32 are upwardly spring biased by means of two springs 39 mounted to the frame 3.

As the eccentric wheel 18 turns, the holders 32 move up and down depending on the position of the attachment assembly 35 on the eccentric wheel 18, i.e., the current distance of the attachment assembly 35 from the solid shaft 16 on which the eccentric wheel 18 is mounted. The wheel 18 is shaped so as to lower the holders 32 and therewith the targets to the lower support plate 8 during the cocking operation. Due to the cross-shaped apertures through which the holders 32 run, the targets will be ready to be thrown when the holders 32 are in their lowest position shown in FIG. 6.

Figure 5:
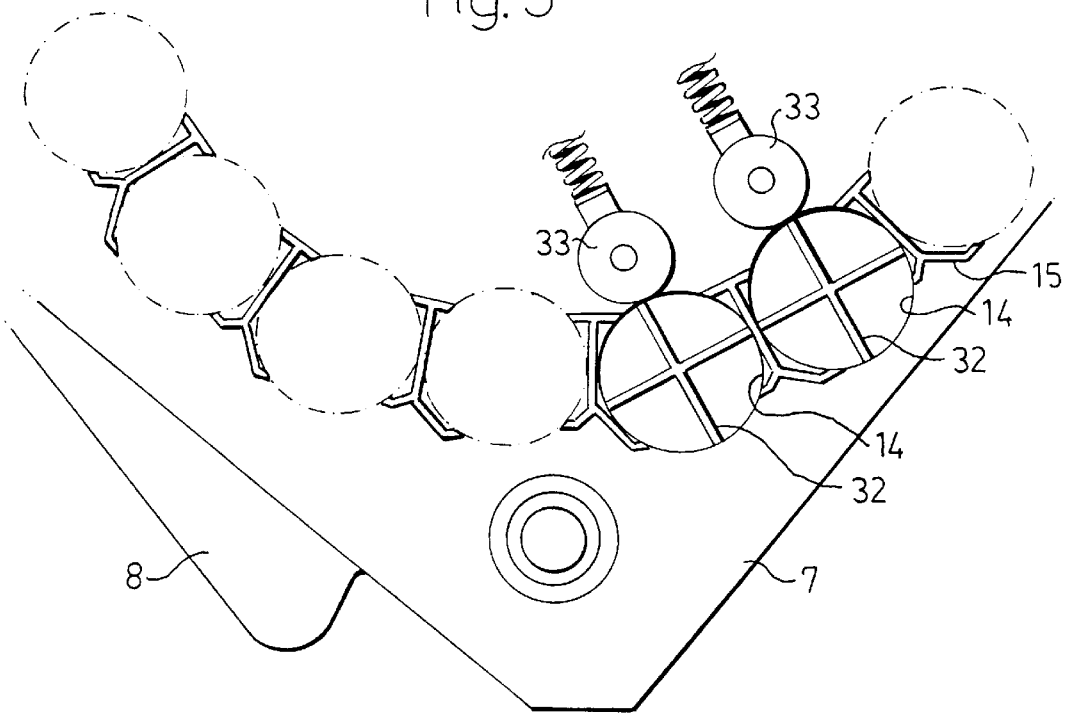
FIG. 5 is a top view showing a target retaining arrangement in more detail.

To prevent the entire stacks of targets to follow the elevator assembly, two spring-loaded clamping wheels 33 are provided inside of the target stacks on level with the second lowest target 13 of the stacks, see FIG. 5. These clamping wheels 33 will retain the stacks in position except the lowest target in each stack above the elevator assembly and thus only the lowest target will be brought to the lower support plate.

The function of the turnable disc 34 will now be explained with reference to FIG. 1. In the angular position of disc 34 shown in FIG. 1, the two holes 14 are positioned directly above a respective holder 32 of the elevator assembly.

However, in some cases you want just one target to drop to the throwing position on the lower support plate 8, e.g. during single target shooting, or even that the elevator function is totally disabled, e.g. during testing. In those cases, the turnable disc 34 can be turned to an angular position, in which only one or none of the holes 34 is aligned with the stacks of targets 13 during rotation of the magazine 2. The disc 34 is locked in position by some suitable means, such as a screw (not shown) passing through the center of the disc 34.

Since the throwing arm 5 will overshoot the angular position in which it started, i.e., the resting position, a mechanism (not shown) preventing rotation of the hollow shaft 17 in the opposite direction is preferably provided. In that way, the throwing arm 5 will not begin the cocking operation from the resting point but from a point, in which the traction spring 30 is slightly loaded. This feature will save some of the energy needed to cock the throwing arm.

While a preferred embodiment has been shown and described, various modifications may be made thereto without departing from the inventive idea of the present invention. Accordingly, it is to be understood that the present invention has been described by way of illustration and not limitation.

In the shown embodiment, a tap provided on the drive wheel 20 and a groove is provided in the drive wheel 23. The reverse would work equally well, i.e., with a tap provided on the driven wheel 23 and a groove provided in the drive wheel 20.

We claim:

1. A target throwing device having a) a first pivotal shaft, b) an arm mounted to said first shaft for throwing at least one target, c) a spring means connected for rotation of said arm during a target throwing operation, d) an eccentric first wheel mounted on said first shaft, wherein said spring means is connected to said first shaft by means of said first wheel, e) a second pivotal shaft, said second shaft being essentially coaxial with said first shaft, f) a drive motor means coupled to said second pivotal shaft for rotation thereof, and g) means for interconnecting said first and second shafts so as to permit mutually independent rotation of said first and second shafts through an angle of between essentially 180° and 360°.

2. A target throwing device according to claim 1, wherein said means for interconnecting the first and second shafts comprise a second wheel provided on the first shaft and a third wheel provided on the second shaft, said second and third wheels comprising a circular groove and a tap, respectively, wherein, during a cocking operation, said tap abuts an end of said groove interconnecting the rotational movement of said second and third wheels, whereby said drive motor means imparts a rotational movement to said first shaft, and during a throwing operation, said spring means imparts a high speed rotational movement to said first shaft and said tap is allowed to run in said groove, whereby said first shaft can rotate independently of said second shaft.

3. A target throwing device according to claim 1, wherein said first wheel is coupled to a ring by means of a bearing, and wherein a first end of said spring means is secured to said ring and a second end of said spring means is secured to a frame of the target throwing device.

4. A target throwing device according to claim 1, wherein said first shaft is hollow and said second shaft is solid, and wherein the second shaft is partially mounted in the first shaft.

5. A target throwing device according to claim 1, wherein a gear ring is mounted on said second shaft, said gear ring driving a magazine intended for targets.

6. A target throwing device according to claim 1, having a plate for supporting targets in a magazine, and a rotatable, essentially circular disc on level with said plate for supporting targets, said circular disc being provided with two holes, wherein said circular disc can be rotated to a position, in which two, one or no hole(s) are positioned below the targets in the magazine.

7. A target throwing device according to claim 1, having an elevator arrangement for targets, comprising a fourth eccentric wheel mounted to said second shaft and provided with a flange, an attachment assembly mounted to said flange, a spring biased holder for at least one target and designed for vertical movement, and means interconnecting said holder and said attachment assembly, wherein the eccentricity of the fourth wheel imparts a displacement of the holder during rotation of the second shaft and thereby the fourth wheel.

* * * * *